United States Patent [19]

Dwight

[11] 4,131,417

[45] Dec. 26, 1978

[54] CARBON ELECTRODE PRODUCTION

[75] Inventor: Donald D. Dwight, Albemarle, N.C.

[73] Assignee: Aluminum Company of America, Pittsburgh, Pa.

[21] Appl. No.: 806,714

[22] Filed: Jun. 15, 1977

[51] Int. Cl.[2] ..... F27D 5/00

[52] U.S. Cl. ..... 432/6; 432/192

[58] Field of Search ..... 432/5, 6, 192

[56] References Cited

U.S. PATENT DOCUMENTS

| | | | |
|---|---|---|---|
| 2,376,655 | 5/1945 | Brotz | 432/6 |
| 3,048,382 | 8/1962 | Mansfield | 432/192 X |
| 3,898,108 | 8/1975 | Iwasaki et al. | 432/5 |

*Primary Examiner*—John J. Camby

*Attorney, Agent, or Firm*—Daniel A. Sullivan, Jr.

[57] ABSTRACT

A method including baking two carbon articles in a chamber, wherein the improvement comprises the steps of:

a. providing a protrusion and a stub hole on a face of one of the articles and arranging the articles side by side in the chamber with said protrusion and said stub hole located between the articles, whereby during baking any bonding between the articles is limited to the region of the protrusion so that the articles can later be separated with relative ease, and b. subsequently baking the carbon articles in the presence of a carbonaceous particulate support, with the carbonaceous particulate support being present in the stub holes, whereby the prevention of stub hole distortion and adjoining carbon article blistering is improved.

2 Claims, 4 Drawing Figures

CARBON ELECTRODE PRODUCTION

BACKGROUND OF THE INVENTION

The present invention relates to a method of baking carbon articles in a chamber. More particularly, this invention relates to a method of baking carbonaceous electrode materials of the type made of a mixture of calcined carbonaceous aggregate and a pitch binder.

It has been found that if the pitch content in the carbon electrodes is steadily increased, there comes a time when certain problems appear during the baking process. First of all, an increase in pitch binder content can lead to sticking problems between the articles as the pitch tends to exude somewhat from the articles as they are baked. Manual separation of bonded electrodes is costly timewise and leads to damaged electrodes which have to be scrapped. More importantly in the case of anodes for use in Hall-Heroult cells for producing aluminum, increasing the pitch binder content leads to distortion of the cross-section of the stub holes in anodes. This results in a poor fit between the steel stub and the anode and possible failure of the joint in the reduction cell.

SUMMARY OF THE INVENTION

In view of the problems outlined above, it is an object of the present invention to provide an improved method of baking carbon articles in a chamber. This method reduces the chance of the carbon articles becoming stuck together as they are baked. The method additionally serves to improve the prevention of distortion of the cross-section of the stub holes in anodes. Additional objects of this invention will become apparent from the drawings, description and claims appended hereto.

In accordance with these objects there is provided a method of baking two carbon articles in a chamber, with the improvement involving the steps of: a)providing a protrusion and a stub hole on a face of one of the articles and arranging the articles side by side in the chamber with the protrusion and said stub hole located between the articles, whereby during baking any bonding between the articles is limited to the region of the protrusion so that the articles can later be separated with relative ease, and b) subsequently baking the carbon articles in the presence of a carbonaceous particulate support, with the carbonaceous particulate support being present in the stub holes, whereby the prevention of stub hole distortion and adjoining carbon article blistering is improved.

DESCRIPTION OF THE PREFERRED EMBODIMENTS

In accordance with the present invention, a carbon electrode is produced with a protrusion provided on a face of the electrode.

Carbon electrodes are generally made from a mixture of carbon filler and binder, such as coke and pitch respectively. The coke component includes various sieve fractions of calcined delayed petroleum coke. A typical delayed coke size distribution is shown in Table I.

Table I

| Tyler Screen Mesh per Lineal Inch | Weight Percent Retained |
|---|---|
| 4 | 8.9 |
| 8 | 6.23 |
| 14 | 18.30 |
| 28 | 12.84 |
| 48 | 7.78 |
| 100 | 7.14 |
| 200 | 13.04 |
| Pan | 25.77 |

Figure 4:
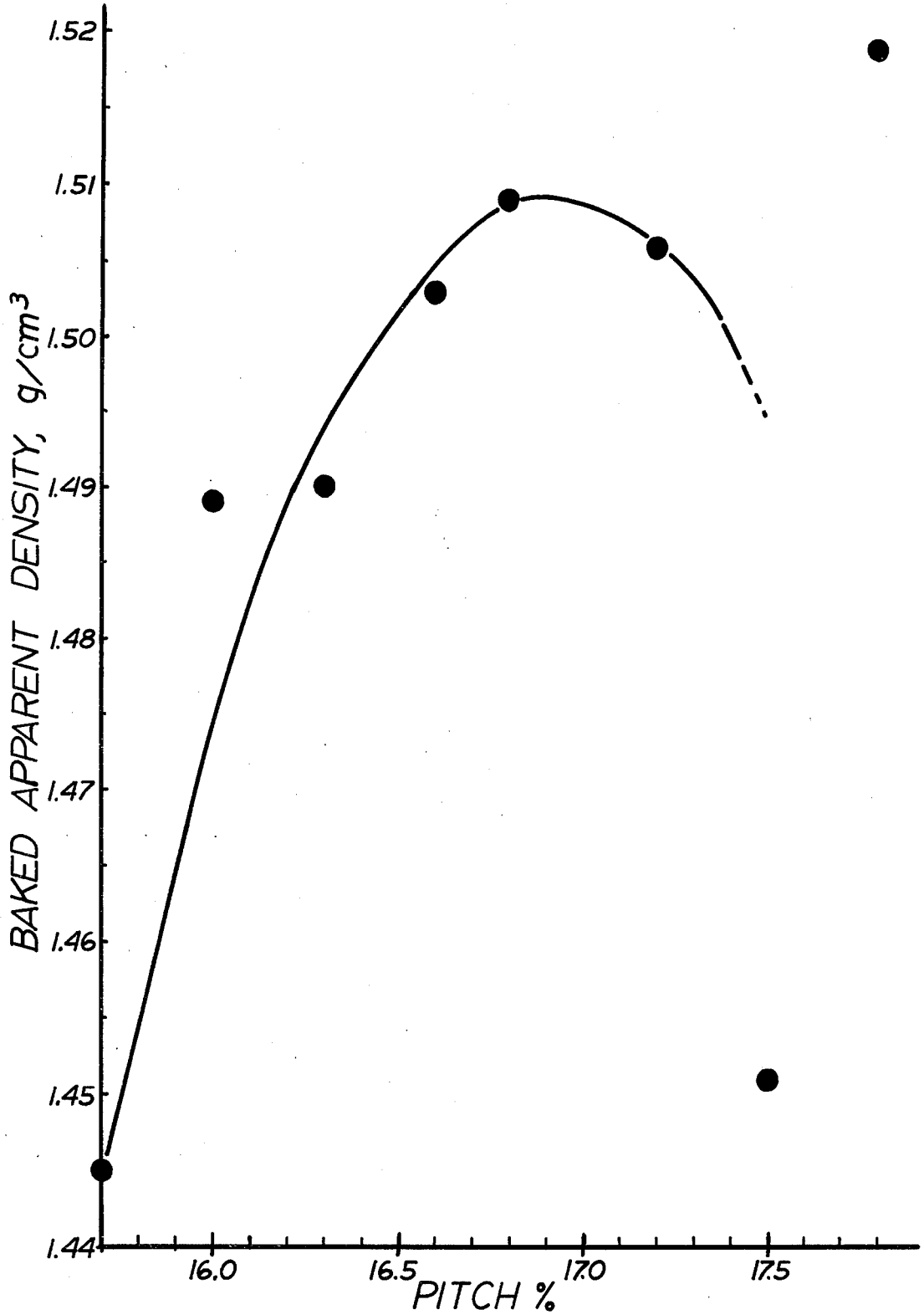
FIG. 4 is a graph of baked apparent density versus pitch content for a series of anodes.

For obtaining maximum baked apparent density, the delayed coke component with a size distribution as shown will make up 83.2% by weight of the filler-binder mixture. The remaining 16.8% by weight of the mixture is an organic binder such as coal tar pitch of softening point = 110° C. as determined by the following method: ASTM D2319. This optimum percentage was determined by preparing a series of electrodes containing 15.7% through 17.8% pitch, remainder the above delayed coke. After forming and baking, the baked apparent density of the electrodes was measured. A graph of the baked apparent density versus pitch content of the electrodes is shown in FIG. 4. As can be seen in the graph, a maximum in the baked apparent density occurs at 16.8% pitch. After 17.2%, the results become erratic due to excessive slumping or other reasons.

The series of electrodes was made by heating the carbonaceous aggregate-pitch mixture to about 150° C. and kneading to obtain a homogeneous paste. Then the paste was cooled to about 130° C. and formed into an electrode by molding, in a hydraulic press.

Figure 1:
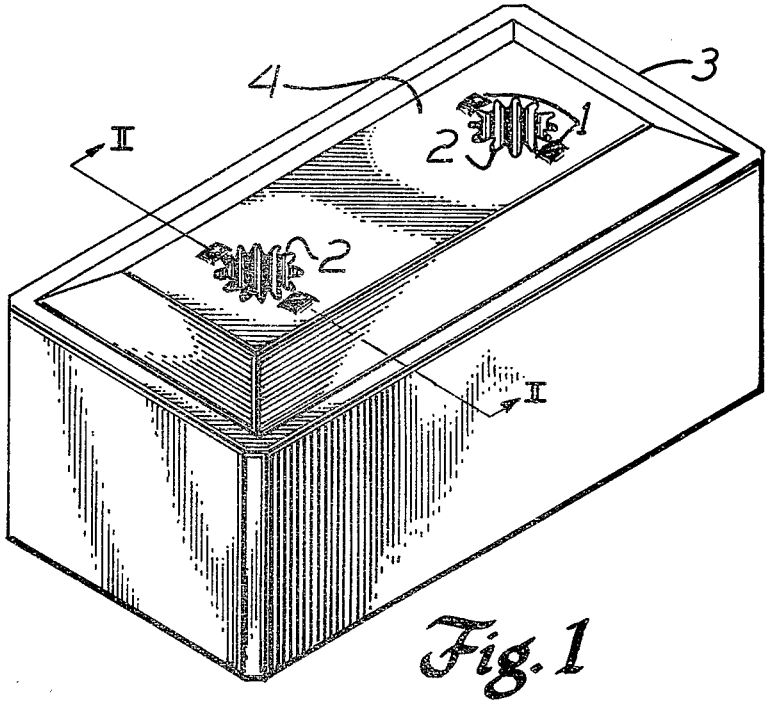
FIG. 1 is a perspective view of an electrode used in an embodiment of the method of the present invention.
Figure 2:
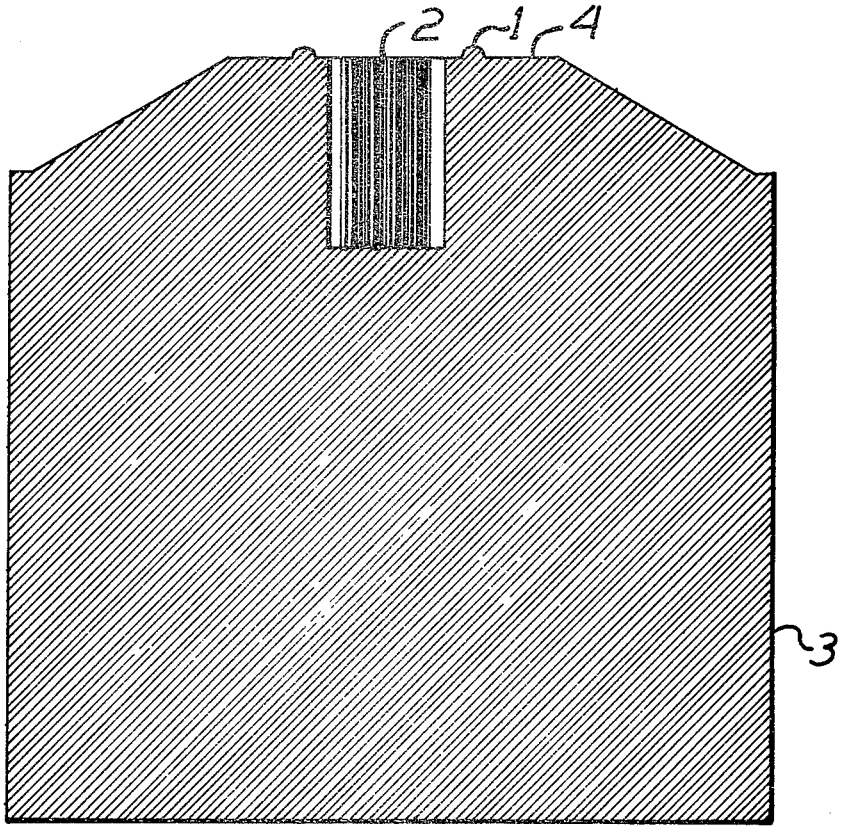
FIG. 2 is a cross-sectional view as indicated by line II–II of FIG. 1.

During the forming process a protrusion is produced on a face of the anode. This protrusion is in the form of an elevated ridge or more preferably in the form of a plurality of elevated projections as shown in FIGS. 1 and 2 for an exemplary anode to be used in the electrolysis of alumina dissolved in a molten cryolite-based salt. The protrusions 1 are located on the top face 4 of the anode 3 in close proximity to the stub holes 2. The protrusions are formed by milling indentations into the base of the dies which form the stub holes. Each protrusion projects from the face of the anode at least ¼ inch.

The carbon electrodes, e.g. anodes, are baked in a ring furnace, the operation of which is described, for instance, in Racunas et al. U.S. Pat. No. 3,975,149.

Figure 3:
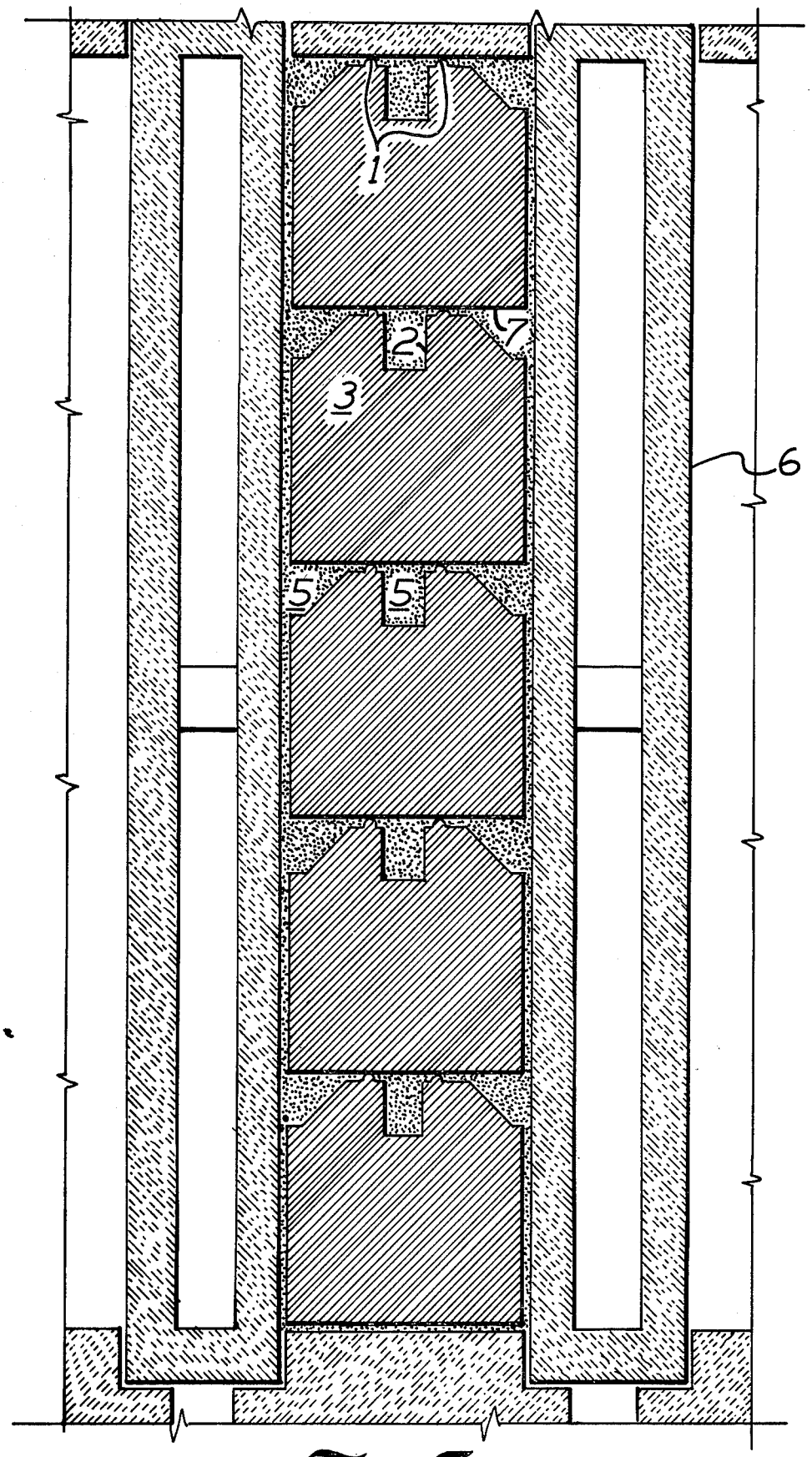
FIG. 3 is a cross-sectional view of a portion of a ring furnace containing electrodes for the invention, the plane of the cross section lying in the horizontal.

A carbon baking ring furnace is composed of a number of pits for baking the anodes. The anodes are packed into the pits either upright or on end, with particulate coke packing material for support as the anodes soften during baking. A top blanket of coke is added to insulate and seal the pit. The preferred type of packing material is in the form of very small spherical coke particles generally known as fluid coke. A preferred arrangement of the anodes in a ring furnace is illustrated in cross section in FIG. 3.

After the anodes have been formed, as they cool down, the protrusions 1 become hard due to the increased viscosity of the pitch at lower temperatures. The resulting strengthened condition of the protrusions allows a group of anodes such as the five shown in FIG. 3 to be grasped and squeezed together by a clamp of a lifting crane. The group of anodes can thus be lifted from a holding area down the line from the forming operation and set down into the pit, with the protrusions retaining a protective spacing between neighboring anodes to prevent anything but minimal bonding together of the anodes during subsequent baking. Thus, it has been found that, in trying for maximum baked apparent density at, for instance, a pitch content of 16.8%, pitch exudation can occur to such an extent that, if neighboring anodes are touching during baking, they get bonded so tightly together that it becomes impossible to break them apart. With protrusions 1 present, any bonding is limited to them, and it is easy to break or saw through these few points of bonding.

The protrusions 1 additionally permit the carbonaceous packing media 5 to fill the spaces between the anodes 3 in the furnace pit 6. In addition, the packing media fills the stub holes 2 in the anodes 3 and resides there during baking. The fluid coke packing media can thereby provide adequate support to the stub holes of the anodes and protect the cross section of the stub holes from distortion. The presence of packing media in the stub holes also serves to improve the prevention of blisters forming on the bottom face 7 of an adjoining anode in the pit. Such blisters are about the same size as the stub hole 2 and occur opposite each empty stub hole on the bottom face 7 of each adjoining anode. The blisters protrude from the bottom face of each anode about ½ inch. Blister formation on the anode bottom face causes problems in conveying the baked anodes and possible carbon dusting in the reduction cell due to separation of the blister from the main portion of the anode. Furthermore, the presence of supporting media between anodes gives additional protection against there being anything but minimal sticking together during baking.

Having thus described the invention and certain embodiments thereof, I claim:

1. A method including baking two carbon articles in a chamber, wherein the improvement comprises the steps of: a) providing a protrusion and a stub hole on a face of one of the articles and arranging the articles side by side in the chamber with said protrusion and said stub hole located between the articles, whereby during baking any bonding between the articles is limited to the region of the protrusion so that the articles can later be separated with relative ease, and b) subsequently baking the carbon articles in the presence of a carbonaceous particulate support, with the carbonaceous particulate support being present in the stub holes, whereby the prevention of stub hole distortion and adjoining carbon article blistering is improved.

2. The method of claim 1 wherein said protrusion protrudes from said face at least ¼ inch and is located adjacent the stub holes of the carbon article.

* * * * *